United States Patent [19]

Rittner

[11] 4,095,372

[45] Jun. 20, 1978

[54] PROTECTOR BAR

[76] Inventor: Ronald C. Rittner, 941 Hemlock St., Rochester, Mich. 48063

[21] Appl. No.: 756,127

[22] Filed: Jan. 3, 1977

[51] Int. Cl.[2] ..... E05B 1/00

[52] U.S. Cl. ..... 49/460; 293/DIG. 4

[58] Field of Search ..... 49/460, 461, 462; 16/1, 16/DIG. 2, DIG. 5, DIG. 17; 293/DIG. 4, 62

[56] References Cited

U.S. PATENT DOCUMENTS

| | | | |
|---|---|---|---|
| 980,193 | 1/1911 | Brenia | 16/DIG. 2 |
| 2,226,615 | 12/1940 | Killen | 16/DIG. 2 |
| 2,582,526 | 1/1952 | Burdick | 16/DIG. 5 |
| 2,870,493 | 1/1959 | Beyrle | 49/460 |

*Primary Examiner*—Philip C. Kannan

[57] ABSTRACT

Disclosed is a protector bar that is adapted to be fastened to a door adjacent the lock or handle of the door to prevent the lock or handle from being damaged by objects, such as carts or tables, that pass through the doorway or are pushed into the door to open it. The protector bar essentially comprises a deflector portion which fastens to the face of the door and extends therefrom at an acute angle relative to the plane of the door, and a projection portion integral to the deflector portion that is fastened adjacent the handle of the door and extends perpendicular from the surface of the door a distance slightly greater than the distance the handle protrudes from the door.

8 Claims, 10 Drawing Figures

FIG. 1.
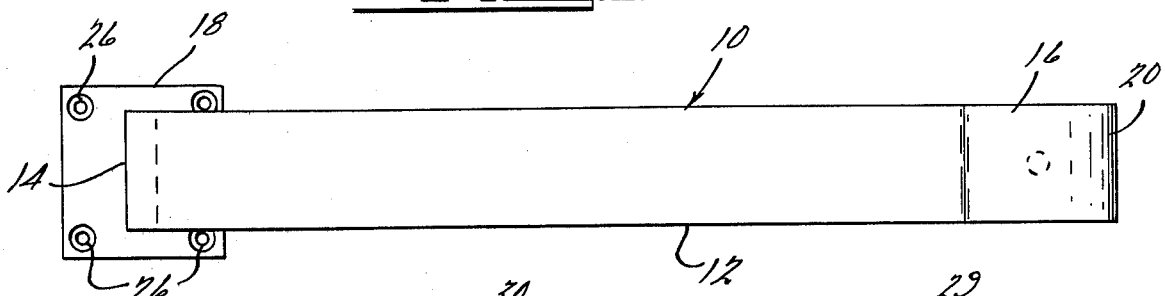
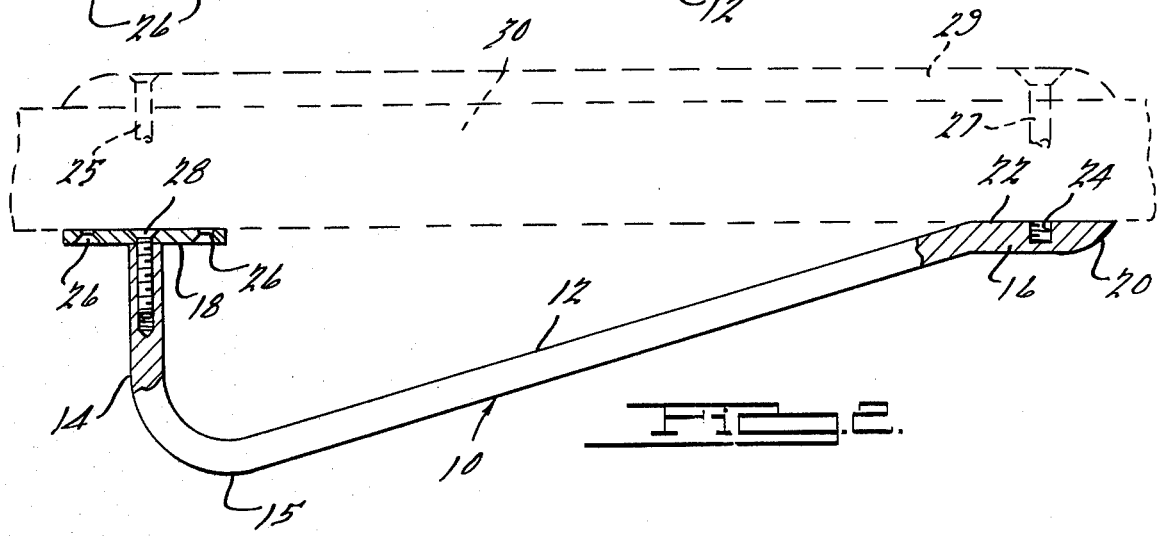
FIG. 2.
FIG. 4.
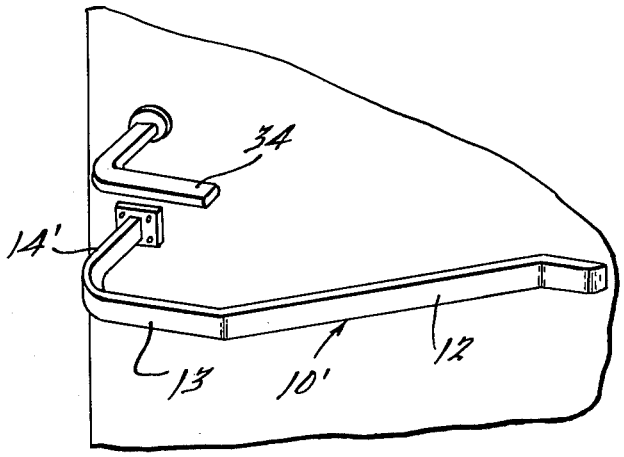
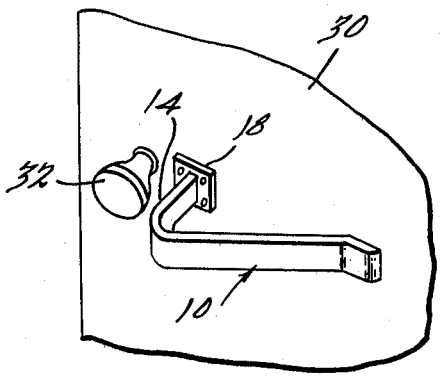
FIG. 3.

FIG. 5.
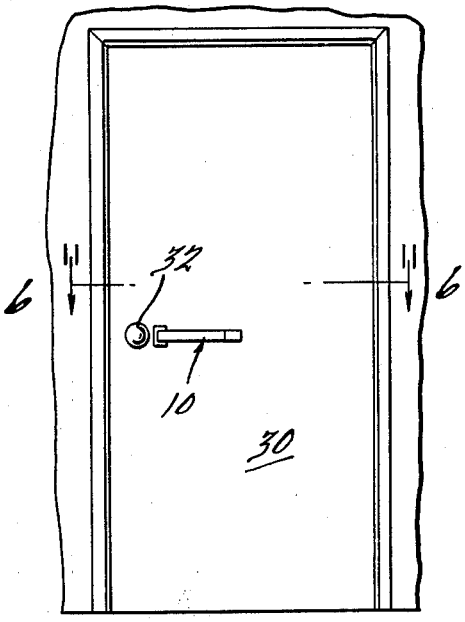
FIG. 7.
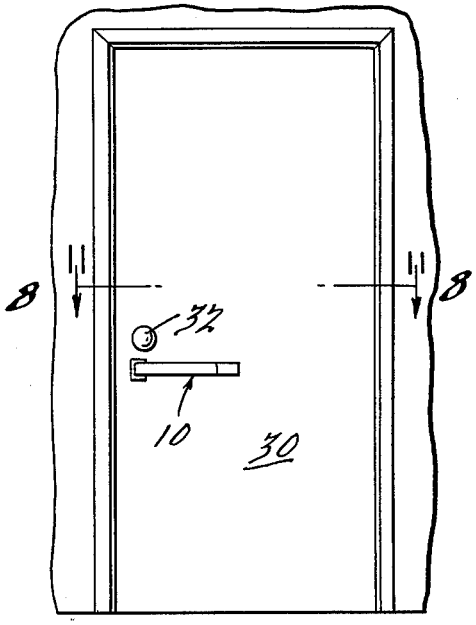
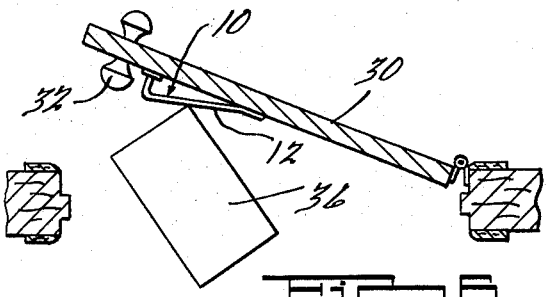
FIG. 6.
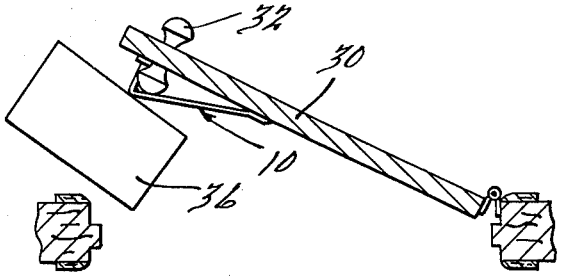
FIG. 8.
FIG. 9.
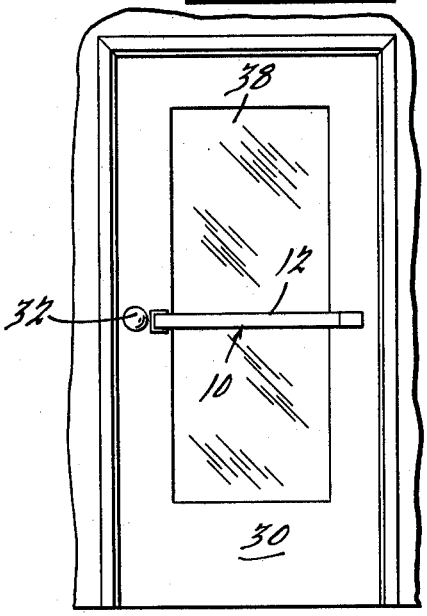
FIG. 10.
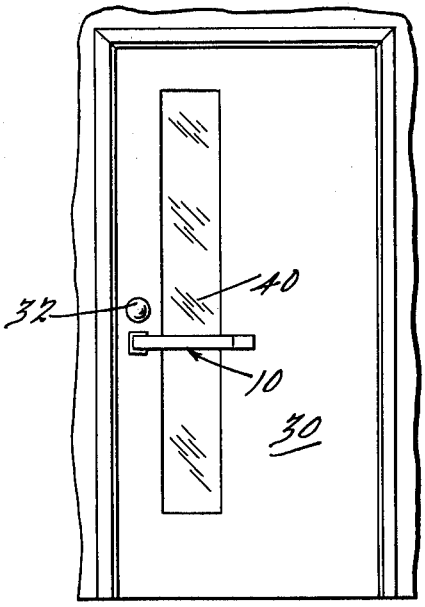

PROTECTOR BAR

BACKGROUND AND SUMMARY OF THE INVENTION

The present invention relates to a protector bar that is adapted to deflect away from the lock or handle of a door objects that pass through the open doorway or are pushed into the door to open it.

It is a common occurrence in many facilities for an individual pushing a cart or other mobile object to pass through a closed doorway by forcing the cart into the door to deflect it open. When this is done, the cart typically strikes the knob or handle protruding from the door which, if repeated often enough, can damage both the door and handle. In hospitals, for example, it is common practice for patients, medicine, and equipment to be transported through doorways in this manner, especially in emergency situations. This of course can, over a period of time, result in substantial damage to doors, door locks and handles, thus giving rise to significant maintenance expenses. In many such facilities, metal coverings are placed over the impact areas on the surface of the door to minimize the damage to the door. However, these measures do nothing to protect the door locks and handles.

The present invention alleviates these problems by providing a protector bar that is designed to protect not only the lock or handle from being struck by a cart or other moving object, but also to deflect and distribute the impact of the cart to minimize damage to the door. The protector bar according to the present invention essentially comprises an integral bar having a deflector portion and a projection portion. The protector bar is intended to be fastened horizontally to the door with the projection portion adjacent to the lock or handle of the door. When mounted, the deflector portion of the bar extends at an acute angle from the surface of the door, and the projection portion extends perpendicular from the door a distance at least as great as the distance the lock or handle protrudes from the door. The edge of the deflector portion where it fastens to the door is beveled so that objects striking the door will not catch on the end of the protector bar. In addition, the deflector end of the bar has a flat mounting pad that sits flush against the surface of the door and serves to distribute the impact of an object striking the bar. Similarly, a mounting plate is fastened to the projection end of the bar flush with the surface of the door to displace the impact at that end of the bar.

As will subsequently be described in greater detail, the size and shape of the protector bar can be readily modified for particular applications on different types of doors. For example, the length of the bar can be expanded to protect a glass area on a door, or the shape of the bar can be slightly modified to properly protect various types of lever door handles.

Other objects and advantages of the present invention will become apparent from a reading of the following detailed description of the preferred embodiments which makes reference to the following set of drawings in which:

BRIEF DESCRIPTION OF THE DRAWINGS

FIG. 1 is a view of the protector bar according to the present invention;

FIG. 2 is another view of the protector bar shown in FIG. 1;

FIG. 3 is an illustration of a typical application of the protector bar shown in FIG. 1;

FIG. 4 is a plan view of a modified version of the protector bar according to the present invention;

FIG. 5 is an illustration of one of the preferred manners of mounting the protector bar to a door;

FIG. 6 is a sectional view of the door illustrated in FIG. 5 taken along the line 6—6;

FIG. 7 is an illustration of another preferred manner of mounting the protector bar to a door;

FIG. 8 is a sectional view of the door illustrated in FIG. 7 taken along line 8—8;

FIG. 9 illustrates a modified form of the protector bar; and

FIG. 10 illustrates another modified form of the protector bar.

DETAILED DESCRIPTION OF THE PREFERRED EMBODIMENTS

Referring to FIGS. 1 and 2, a detailed view of the protector bar 10 according to the present invention is shown. The preferred embodiment of the protector bar 10 is manufactured from ⅜ inch × 1½ inches stainless steel stock. However, it is to be understood that other suitable materials possessing similar properties of rigidity, relative low cost, ease of manufacture, and pleasing appearance, could also be used. Stainless steel is preferred because it can typically be finished to match the other hardware on the door.

The protector bar 10 according to the present invention comprises a deflector portion 12 and a projection portion 14. As can best be seen in FIG. 2, the deflector portion 12 forms an acute angle relative to the plane of the door 30 when the bar 10 is mounted. As is more fully illustrated in the subsequent figures, the angle of the bar is designed to deflect carts and other objects away from the protruding lock or handle of the door. In addition, the angle of the bar serves to deflect the force of a cart striking the bar, thereby reducing the impact on the door. The deflector end of the bar 10 has a flat section 16, referred to as a mounting pad, that is used to secure that end of the bar 10 to the door 30. The back side 22 of the mounting pad 16 is flat so that it will lay flush against the surface of the door 30. It will be noted, that the mounting pad 16 is internally threaded at 24 from the back surface 22, so that there will be no protruding screw head on the exposed surface of the mounting pad 16 to mar objects that come in contact with the bar 10. Additionally, the edge of the mounting pad 16 is beveled at 20 so that objects striking the surface of the door will not catch on the edge of the bar 10. It is to be understood, that the term "beveled" is intended to include a somewhat rounded edge as illustrated in the drawings.

The projection end of the bar 10 is fastened to a mounting plate 18 by a pair of machine screws 28. Alternatively, the mounting plate 18 may simply be welded to the end of the bar 10. In addition to providing a convenient surface for mounting the bar 10 to the door 30, the mounting plate 18 also serves to distribute over the surface of the door the impact of an object striking the bar 10. It will further be noted that the mounting pad 16 at the opposite end of the bar 10 also serves the same function of displacing the force of an object striking the bar 10. The size of the mounting plate 18, can of course, be varied according to the particular application involved. However, a 2 inch square stainless steel plate has been found to be adequate for most purposes. The mounting plate 18 illustrated in FIGS. 1 and 2 is adapted to be fastened to the door 30 by four wood screws 26. However, depending upon the particular construction of the door, a set of bolts 25 extending through the door may also be used.

In addition, where the bar 10 is mounted to a hollow-core door, for example, it may be desirable to include a supporting bar 29 constructed of material similar to the bar, to be mounted to the opposite side of the door 30 by the same through bolts 25 and 27 to which the bar 10 is secured, to provide added support for the bar 10 and increase the integrity of the door.

Referring now to FIG. 3, one of the preferred manners of mounting the protector bar 10 of the present invention to a door 30 is shown. As the diagram illustrates, the bar 10 is mounted to the door 30 in horizontal alignment with the handle 32 of the door. The projection end of the bar 10 is mounted sufficiently close to the handle 32, without obstructing its use to open the door 10, so that objects striking the bar 10 will be deflected over the handle 32. Importantly, it will be noted that the projection portion 14 of the bar 10 protrudes from the plane of the door 30 a greater distance than the handle 32. Returning momentarily to FIG. 2, it will be appreciated that the length of the projection portion 14 must be such that the apex 15 of the bar 10 extends a greater distance from the surface of the door 30 than the protruding piece of hardware on the door 30 which the bar 10 is intended to protect.

Looking to FIGS. 5 and 6, the function of the protector bar 10 is illustrated. In particular, it can be seen that when a cart or other object 36 is pushed into the door 30, it will strike the deflector portion 12 of the bar 10, thereby causing the door 30 to swing open. Due to the angle of the deflector portion 12 of the bar 10, the force of the impact of the cart 36 striking the door is diminished. In addition, the mounting pad 16 and plate 18 associated with the bar 10 serve to displace the force of the impact over a greater surface area of the door 30. Furthermore, it can be seen that as the door 30 is opened against the urging of the cart 36 riding along the length of the deflector portion 12 of the bar 10, the cart 36 will be sufficiently spaced from the surface of the door 30 when it reaches the apex 15 of the bar 10 to pass over the handle 32 without being caught thereon. Thus, the cart 36 can pass through the doorway substantially unimpeded by the door 30 or the door handle 32 protruding therefrom.

Referring now to FIGS. 7 and 8, an alternative manner of mounting the protector bar 10 according to the present invention is shown. The protector bar 10 in this application is horizontally mounted slightly below the handle 32 of the door. As before, the bar 10 is sufficiently spaced from the handle 32 to permit someone to grip the handle 32 to open the door 10. In addition, the bar 10 is mounted so that the apex 15 of the bar 10 is substantially vertically aligned with the door handle 32. In this manner, a cart 36 striking the bar 10 will avoid being caught on the handle 32 of the door 30. The mounting procedure illustrated in FIGS. 7 and 8 is particularly appropriate in situations where the door is stiffly hinged. Specifically, it will be appreciated that with the mounting procedure illustrated in FIGS. 5 and 6, the corner of the cart 36 may nonetheless catch on the handle 32 after it passes the bar 10 if the door 30 is stiffly hinged. The procedure illustrated in FIGS. 7 and 8 eliminates the possibility of this occurring. Accordingly, for such applications, the later alternative is preferred. However, in applications where the doors are typically maintained in the open position and the primary concern is preventing objects passing through the open doorway from striking the protruding door handle, it will be appreciated that either mounting procedure will work equally well.

Referring to FIGS. 9 and 10, additional applications of the protector bar 10 according to the present invention are shown. When mounted to doors 30 containing glass panes 38 and 40, the size of the protector bar 10 may be explained by lengthening the deflector portion 12 so that the bar 10 spans the glass area. When utilized in this manner, the bar 10 provides the additional function of protecting the glass 38 and 40 in the door 30 from breakage or other damage.

Turning now to FIG. 4, an alternative design of the protector bar is illustrated. The protector bar 10' shown in FIG. 4 is an example of a type of design modification which can be made to the bar to adapt it to a particular application. On doors having lever types handles 34 as shown, it can be seen that the embodiment of the protector bar 10 illustrated in the other figures may not completely protect the lever handle 34 from objects striking the bar. In particular, due to the inclination of the deflector portion 12 of the bar 10 illustrated in FIGS. 1 and 2, the lever handle 34 would protrude beyond the bar 10 if mounted in the manner illustrated in FIGS. 7 and 8. Thus, a cart could still catch on the handle 34 notwithstanding the presence of the protector bar 10. Consequently, for this type of application, the modified version of the protector bar 10' shown in FIG. 4 can be utilized. The protector bar 10' in this embodiment comprises a projection portion 14' and a deflector portion 12' as in the previous embodiment, however, an additional straight segment 13 is added between the deflector portion 12' and the projection portion 14'. The straight segment 13 of the bar 10' is designed to parallel the lever handle 34 so that no part of the handle 34 extends beyond the bar 10'. Thus, the handle 34 is completely protected from impact by an object striking the bar 10'.

It is to be understood, that other modifications to the design of the protector bar as described herein to adapt the bar to various other applications are possible without departing from the basic concepts of the present invention.

What is claimed is:

1. A protector bar for a door of a building hinged along one vertical edge having a handle or other piece of hardware protruding from the planar surface of the door comprising:

a first part fastened to said planar surface of said door at a point intermediate said hinged edge and said handle or other piece of hardware and extending therefrom at an acute angle relative to said planar surface, and a second part fastened to said planar surface of said door adjacent said handle or other piece of hardware and extending to said first part substantially normal to said planar surface a distance at least as great as the distance said handle or other piece of hardware protrudes from said door, so that objects striking said bar or said planar surface of said door at a point intermediate said bar and said hinged edge are deflected away from said handle or other piece of hardware.

2. The bar of claim 1 further including mounting means affixed to said second part where it fastens to said door for distributing the impact of an object striking said bar.

3. The bar of claim 1 wherein the edge of said first part where it fastens to said door is beveled.

4. The bar of claim 1 further including support means fastened to the opposite planar surface of said door by fastening means that extend through said door and are secured to said bar.

5. The bar of claim 1 wherein the angle at which said first part extends from said door is less than 30°.

6. The bar of claim 1 wherein said first part is integral to said second part.

7. The bar of claim 1 wherein said first part where it fastens to said door has a flat surface on its backside that sits flush against said planar surface of said door.

8. The bar of claim 7 further including fastening means affixed to said door that are adapted to secure to said backside of said first part of said bar.

* * * * *